US007546650B2

(12) United States Patent
Yue

(10) Patent No.: US 7,546,650 B2
(45) Date of Patent: Jun. 16, 2009

(54) ADJUSTABLE SURGICAL TABLE

(75) Inventor: James J. Yue, Guilford, CT (US)

(73) Assignee: Yale University, New Haven, CT (US)

( * ) Notice: Subject to any disclaimer, the term of this patent is extended or adjusted under 35 U.S.C. 154(b) by 267 days.

(21) Appl. No.: 11/335,680

(22) Filed: Jan. 20, 2006

(65) Prior Publication Data

US 2007/0022535 A1 Feb. 1, 2007

Related U.S. Application Data

(60) Provisional application No. 60/741,890, filed on Dec. 5, 2005, provisional application No. 60/704,193, filed on Jul. 28, 2005.

(51) Int. Cl.
*A61G 13/08* (2006.01)
*A61G 13/12* (2006.01)

(52) U.S. Cl. ..... 5/615; 5/715; 5/710; 5/713; 5/623; 5/624

(58) Field of Classification Search ..... 5/615, 5/715, 601, 612, 710, 713, 731, 733–735, 5/935, 623, 624
See application file for complete search history.

(56) References Cited

U.S. PATENT DOCUMENTS

| | | | | |
|---|---|---|---|---|
| 3,919,730 | A * | 11/1975 | Regan | 5/710 |
| 4,542,547 | A * | 9/1985 | Sato | 5/713 |
| 5,619,764 | A * | 4/1997 | Lopau | 5/713 |
| 6,182,316 | B1 * | 2/2001 | Thomas et al. | 5/722 |
| 7,107,640 | B2 * | 9/2006 | Chapman et al. | 5/710 |
| 7,251,845 | B2 * | 8/2007 | Schaller et al. | 5/613 |

* cited by examiner

*Primary Examiner*—Michael Trettel
(74) *Attorney, Agent, or Firm*—Welsh & Flaxman LLC

(57) ABSTRACT

A surgical table includes a horizontal patient support with a base extending therefrom and supporting the patient support at a desired height. The surgical table also includes an adjustment platform positioned upon the patient support. The adjustment platform includes a plurality of expansion members adapted to selectively adjust the relative position of the patient.

18 Claims, 5 Drawing Sheets

ADJUSTABLE SURGICAL TABLE

CROSS REFERENCE TO RELATED APPLICATION

This application claims the benefit of U.S. Provisional Patent Application Serial No. 60/741,890, entitled "ADJUSTABLE SURGICAL TABLE", filed Dec. 5, 2005, and U.S. Provisional Patent Application Ser. No. 60/704,193, entitled "ADJUSTABLE SURGICAL TABLE", filed Jul. 28, 2005.

BACKGROUND OF THE INVENTION

1. Field of the Invention

The invention relates to an adjustable surgical table. More particularly, the present invention relates to an adjustable surgical table optimizing patient positioning for spine motion implant surgery.

2. Description of the Prior Art

Recent advances in spinal surgery have led to the development of non-fusion based procedures for the repair of damaged and/or deteriorating spinal structures. Many of these procedures require that the surgeon access the space between adjacent vertebrae. Consequently, it is highly desirable that this space be opened as much as possible to allow the surgeon complete access to the area requiring repair.

Currently, the space between adjacent vertebrae is opened by moving the patient as he or she lies upon the surgical table. As those skilled in the art will certainly appreciate, this is often very difficult and offers less then desirable control of the space between vertebrae as the patient is moved along the surgical table. In fact, it is currently common practice to adjust the spine by lifting the buttocks and positioning a towel thereunder.

At the present time, there is no surgical table that will allow for intra-operative lordotic/kyphotic adjustments at multiple levels in the lumbar spine. In addition, there are no surgical tables that allow for this adjustable lordosis with the lower extremities in the abducted position.

Surgical tables that are currently available allow for flexion or extension at a single pivot point in the table. Often these pivot points are not radiolucent and, therefore, do not allow for precise visualization of the anatomic landmarks that are necessary for accurate implant placement.

As such, a need exists for a surgical table, particularly, an adjustable lordotic/kyphotic spinal arthroplasty table, that allows for abduction and flexion and extension of the lower extremities. A need further exists for an adjustable lordotic/kyphotic spinal arthroplasty platform that can be placed on top of an existing surgical table.

SUMMARY OF THE INVENTION

It is, therefore, an object of the present invention to provide a surgical table including a horizontal patient support with a base extending therefrom and supporting the patient support at a desired height. The surgical table also includes an adjustment platform positioned upon the patient support. The adjustment platform includes a plurality of expansion members adapted to selectively adjust the relative position of the patient.

It is also an object of the present invention to provide an adjustment platform including a frame and a plurality of expansion members positioned within the frame. The expansion members are adapted to selectively adjust the relative position of the patient lying upon the platform.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figures 1, 4:
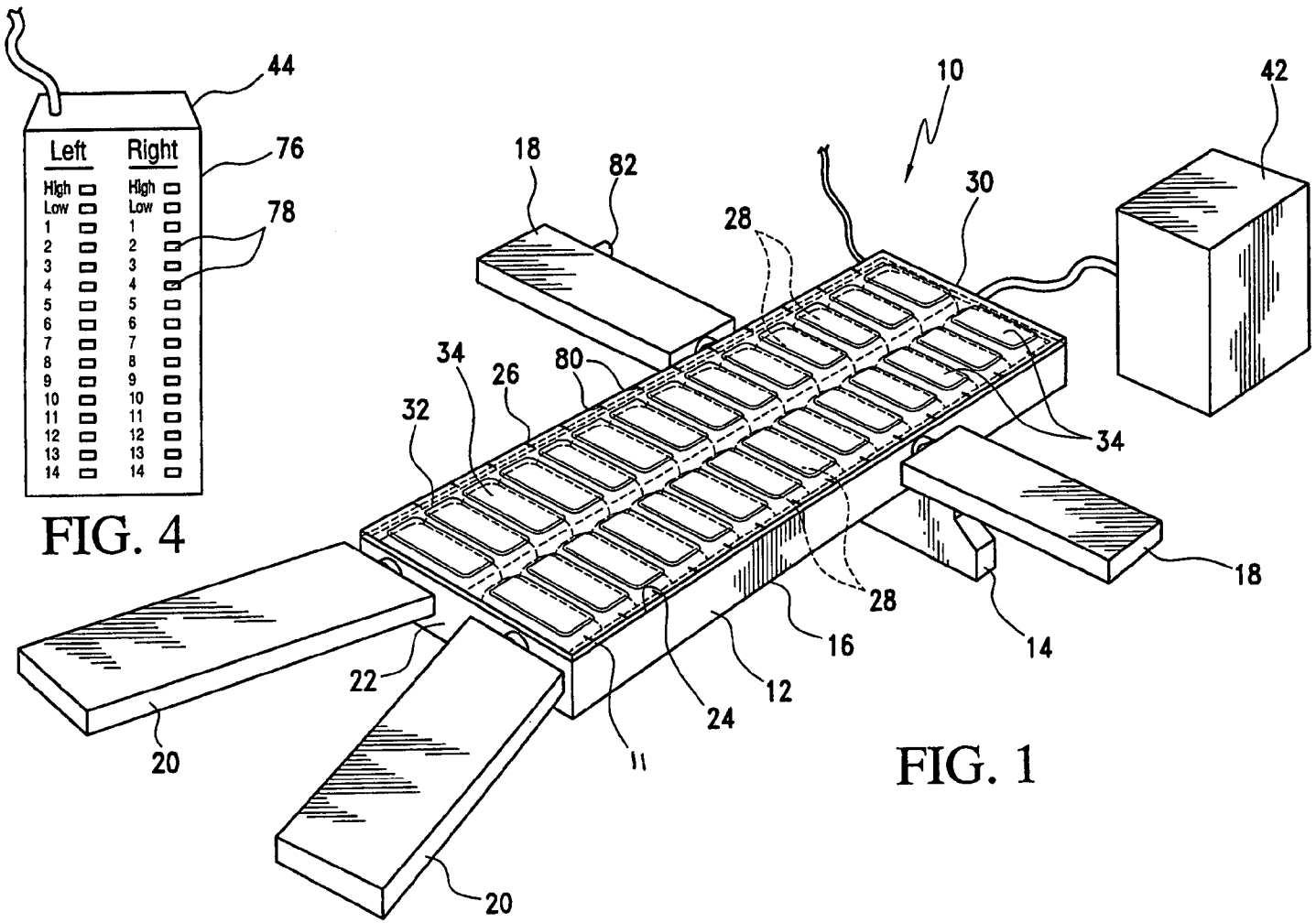
FIG. 1 is a perspective view of an adjustable surgical table in accordance with the present invention.
FIG. 4 is a perspective view of a control unit used in conjunction with the surgical table shown in FIG. 1.
Figure 2:
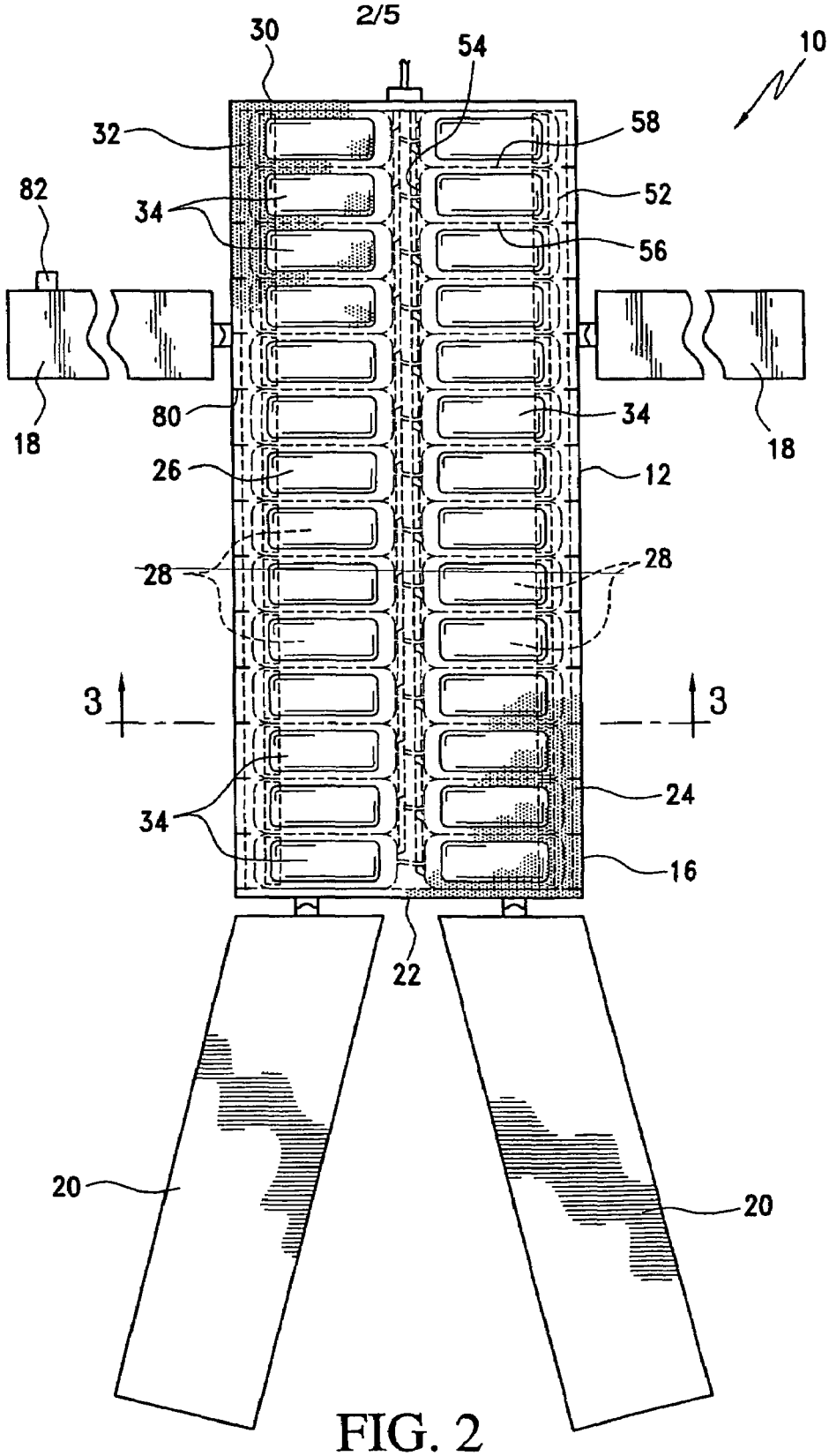
FIG. 2 is a top view of the surgical table shown in FIG. 1.
Figure 3:
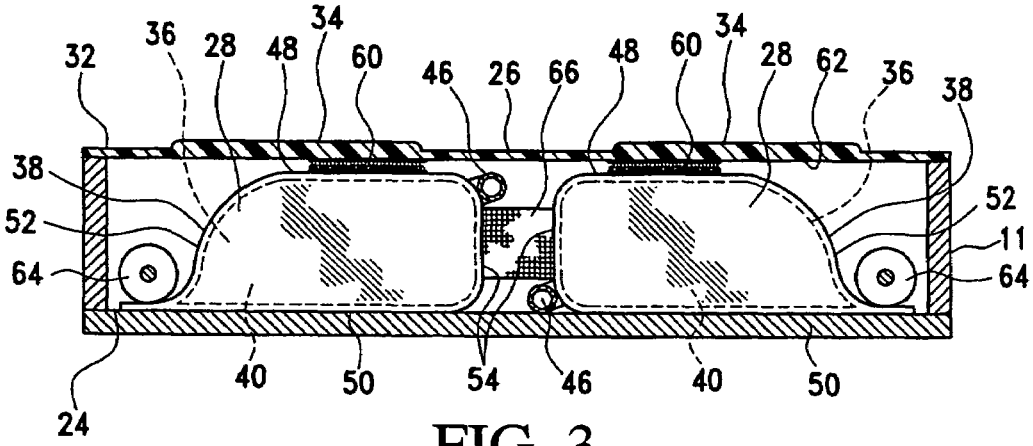
FIG. 3 is a cross sectional view of the surgical table shown in FIG. 2 along the line 3-3.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as the basis for the claims and as a basis for teaching one skilled in the art how to make and/or use the invention.

Referring to FIGS. 1 to 4, an adjustable surgical table 10 is disclosed. In contrast to prior art surgical tables as discussed above, the present surgical table 10 allows for intra-operative lordotic/kyphotic adjustments at multiple levels in the lumbar, thoracic, and cervical spine and allows for adjustable lordosis with the lower extremities in the abducted position. The present surgical table 10 is particularly adapted for lordotic/kyphotic spinal arthroplasty procedures, while allowing for abduction, flexion and extension of the lower extremities. As discussed below in accordance with an alternate embodiment of the present invention, the underlying concepts may be applied to a portable platform 110 that can be placed on top of an existing surgical table.

As with conventional surgical tables, the present surgical table 10 includes a horizontal patient support 12 with a base 14 extending therefrom and supporting the patient support 12 a desired height above the floor, or other support surface. The surgical table 10 also includes a primary body support 16 shaped and dimensioned for supporting a patient's torso, lateral extending arm supports 18, and leg supports 20 extending from a first end 22 of the primary body support 16. As those skilled in the art will certainly appreciate, the arm supports 18 and the leg supports 20 are secured to the primary body support 16 for selectively positioning the patient in a desirable position for performing surgery. For example, the arm supports 18 and leg supports 20 may respectively be oriented at right angles to the primary body support 16 or they may be placed at oblique angles relative to the primary body support 16. In addition, and as those skilled in the art will certainly appreciate, the patient support may also be provided with adjustable arm holders that allow for positioning of the arms in multiple planes. In some instances, such as in lumbar cases around the L1-2 and L2-3 levels, the arms have to be positioned over the chest of the patient.

In view of the need for imaging, the primary body support 16, arm supports 18 and leg supports 20 are made from radiolucent materials. For example, the components of the structures are preferably made from a carbon fiber sandwich, epoxy, decorative foam laminate, polypropylene, phenolic resin, carbon fiber/foam combination, polycarbonate, acrylic polymer or a combination of these materials.

The present invention is primarily directed to performing spinal surgery, and more particularly, to the surgical repair of the spine with non-fusion type spinal systems. As those skilled in the art will appreciate, this surgery currently requires imaging technology necessitating that the patient support be substantially composed of radiolucent materials so as to not interfere with imaging of the spine required for facilitating performance of non-fusion spinal systems.

Positioned on the upper surface 24 of the primary body support 16 is an adjustment platform 26 designed to allow the medical practitioner to adjust the relative position of the patient, for example, to control the spacing between adjacent vertebrae. The adjustment platform 26 includes a frame 11 in which a series of individually controlled expansion members 28 are housed for extending along the length of the primary body support 16 from a first end 22 thereof to a second end 30 thereof. The expansion members 28 are covered with a gel surfacing material 32 so as to provide a patient positioned thereon with a desirable contact surface upon which to lie. It is also contemplated "bean bag" like materials may be used as such materials are known to enhance user comfort. In accordance with a preferred embodiment, the gel surfacing material 32, although a continuous surface, is divided into a series of rectangular sections 34 substantially aligned with the various expansion members 28 making up the adjustment platform 26.

In accordance with a preferred embodiment of the present invention, the expansion members 28 are organized in two columns of approximately fourteen rows. Each expansion member 28 is approximately 10 inches in length and approximately 7 inches to approximately 9 inches in width, and approximately 3 inches to approximately 9 inches in height. As such, the adjustment platform 26 is designed to extend the entire length and width of the primary body support 16, providing for adjustment of patients regardless of their size and position upon the primary body support 16. Although specific parameters are provided in accordance with a preferred embodiment, it is contemplated the arrangement of expansion members may be varied to suit specific applications without departing from the spirit of the present invention, for example, it is contemplated that 3 columns of expansion members may be useful.

In accordance with an alternate embodiment of the present invention, it is contemplated that the length of each expansion member may be varied as they extend from the first end of the primary body support to the second end of the primary body support. For example, 6-inch long expansion members may be used along the lumbar portion of the spinal, 3 to 4 inch long expansion members may be used along the cervical position of the spine and larger expansion members may be used in the central portion of the adjustment platform. Adjustment in this manner allows for greater versatility in spinal adjustments, but might limit usefulness to patients of different sizes where the orientation of the expansion members does not properly align with their dimensions.

The expansion of each expansion member 28 is preferably controlled using a pressurized water or air based actuation system. While water or air are contemplated for use in accordance with a preferred embodiment based upon its compatibility with imaging systems, the pressurizing medium may take a variety of forms without departing from the spirit of the present invention. The actuation system is designed to provide for controlled vertical expansion of the expansion members 28 in a manner lifting or lowering the patient supported thereon in a highly controlled manner.

With this in mind, and in accordance with a preferred embodiment of the present invention, each expansion member 28 includes a bladder 36 having an outer shell 38. The shell 38 is preferably composed of an elastomer, although those skilled in the art will appreciate that other materials may be used without departing from the spirit of the present invention. The shell 38 includes an inner cavity 40 that is connected to a pressurized source of water or air 42, which is pumped into or released from the bladder 36 via fluid tubes 46 under the control of a control unit 44 discussed below in greater detail. The shell 38 further includes an upper surface 48, a lower surface 50, first and second lateral side surfaces 52, 54 and first and second lengthwise side surfaces 56, 58.

As discussed above, a gel surfacing material 32 is positioned upon the expansion members 28. With this in mind, the upper surface 48 of each bladder 36 is provided with hook and loop fastening material 60 for secure engagement with the underside 62 of the gel surfacing material 32.

In addition to simply pumping fluid or air into and out of the bladder 36, controlled lifting of a patient is achieved by the provision of rollers 64 which function to mechanically limit the lateral volume of the bladder 36 so as to force vertical expansion thereof. More particularly, each bladder 36 is provided with a first lateral side surface 52 and second lateral side surface 54. Lateral expansion of the second lateral side surface 54 of each bladder 36 is controlled by the fact that the second lateral side surface 54 of adjacent bladders 36 are in a facing relationship along the length of the adjustment platform 26 and abut with various structures extending along the center of the adjustment platform 26. Similarly, the first and second lengthwise side surfaces 56, 58 of the bladders 36 abut to control expansion along the plane of the adjustment platform 26. Expansion of the bladders 36 in the direction of the second lateral side surface 54, as well as the first and second lengthwise side surfaces 56, 58, is further facilitated by linking the abutting surfaces of the adjacent bladders 36 with a binding material 66, for example, spandex.

As to lateral expansion along the first lateral side surface 52 of the bladder 36, it is controlled by a roller 64 which adjustably contracts or expands the distance from the first lateral side surface 52 of the bladder 36 to the second lateral side surface 54 of the bladder 36 to thereby limit the lateral volume available within the bladder 36, which ultimately forces any applied pressure to expand the bladder 36 in a vertical direction.

The roller 64 functions by engaging the first lateral side surface 52 of the bladder 36, clamping down thereon, and moving inward or outward relative to the first lateral side surface 52 of the bladder 36 to limit the distance from the second lateral side of the expansion member to the roller 64, or first lateral side surface 52, of the bladder 36. As such, when it is desired to elevate a patient at the location of a particular expansion member 28, and a base level of pressure has previously been applied to the expansion member 28, the roller 64 is actuated (for example, via a stepper motor (not shown)) to move toward the second lateral side surface 54 of the bladder 36 causing the bladder 36 to reorient forcing the upper and lower surfaces 48, 50 thereof to move away from each other in a manner elevating the patient positioned thereon. Similarly, when it is desired to lower a patient at the location of a particular expansion member 28, the roller 64 is actuated to move away from the second lateral side surface 54 of the bladder 36 causing the bladder 36 to reorient, forcing the upper and lower surfaces 48, 50 thereof to move toward each other in a manner lower the patient positioned thereon.

Figure 5:
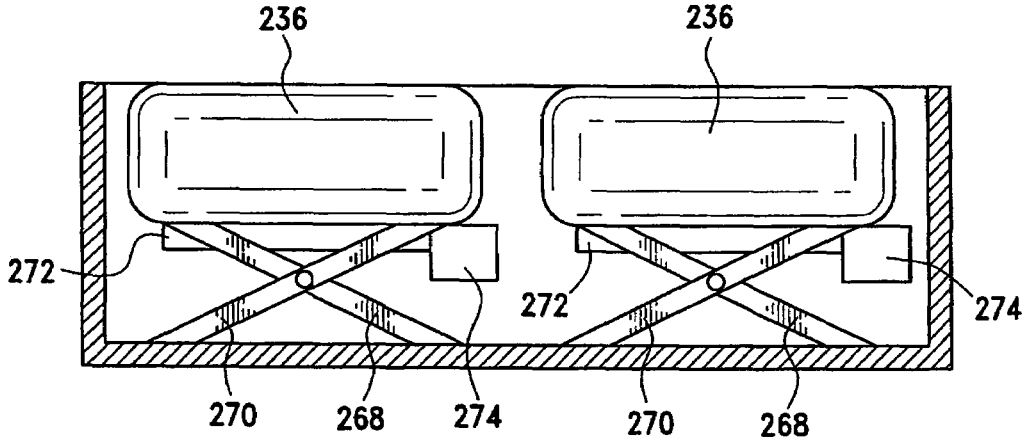
FIGS. 5 and 6 are cross sectional views of the expansion members in accordance with an alternate embodiment.
Figure 6:
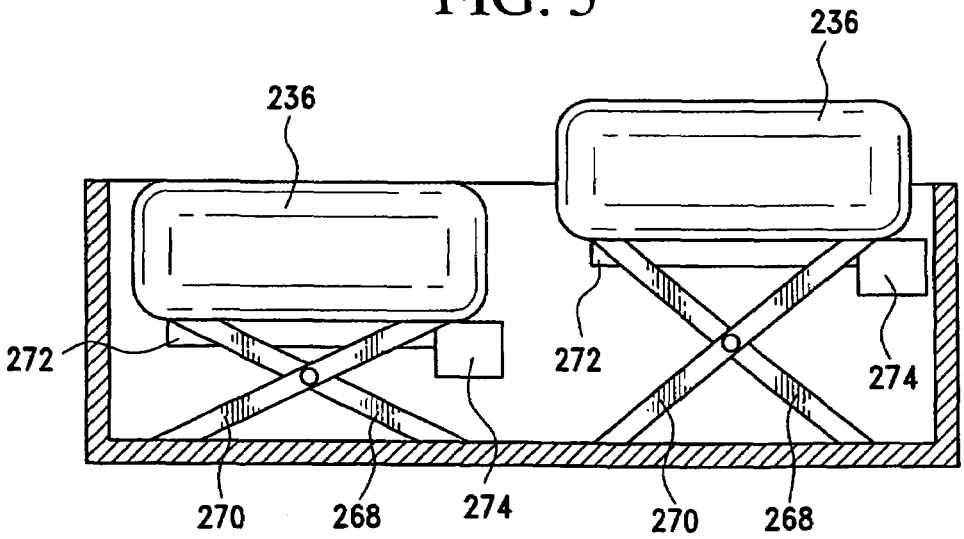
Figures 7, 8, 9:
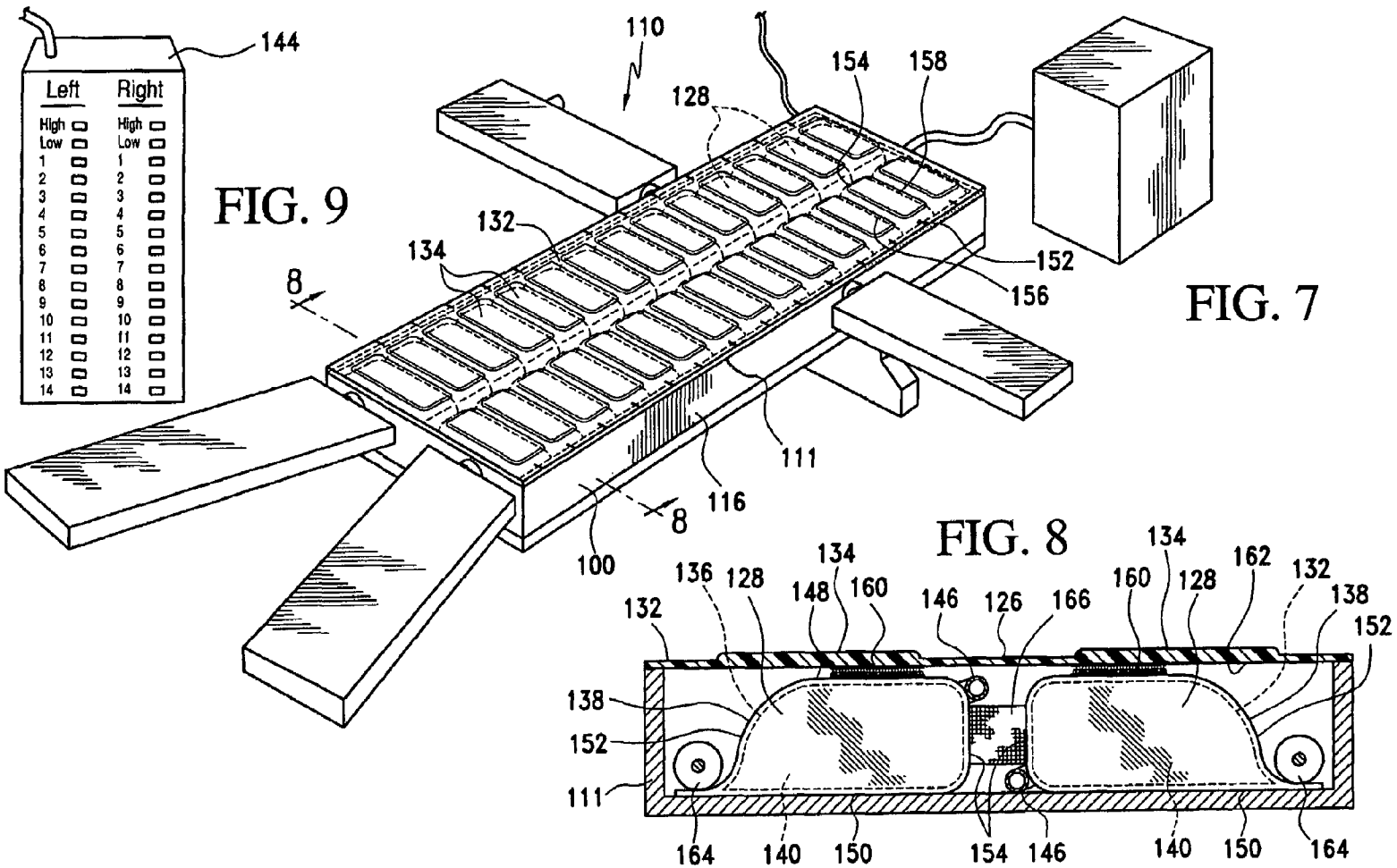
FIG. 7 is a perspective view of a portable platform positioned upon a surgical table in accordance with an alternate embodiment of the present invention.
FIG. 8 is a cross sectional view of the portable platform shown in FIG. 7 along the line 8-8.
FIG. 9 is a perspective view of a control unit used in conjunction with the surgical table shown in FIG. 7.
Figure 10:
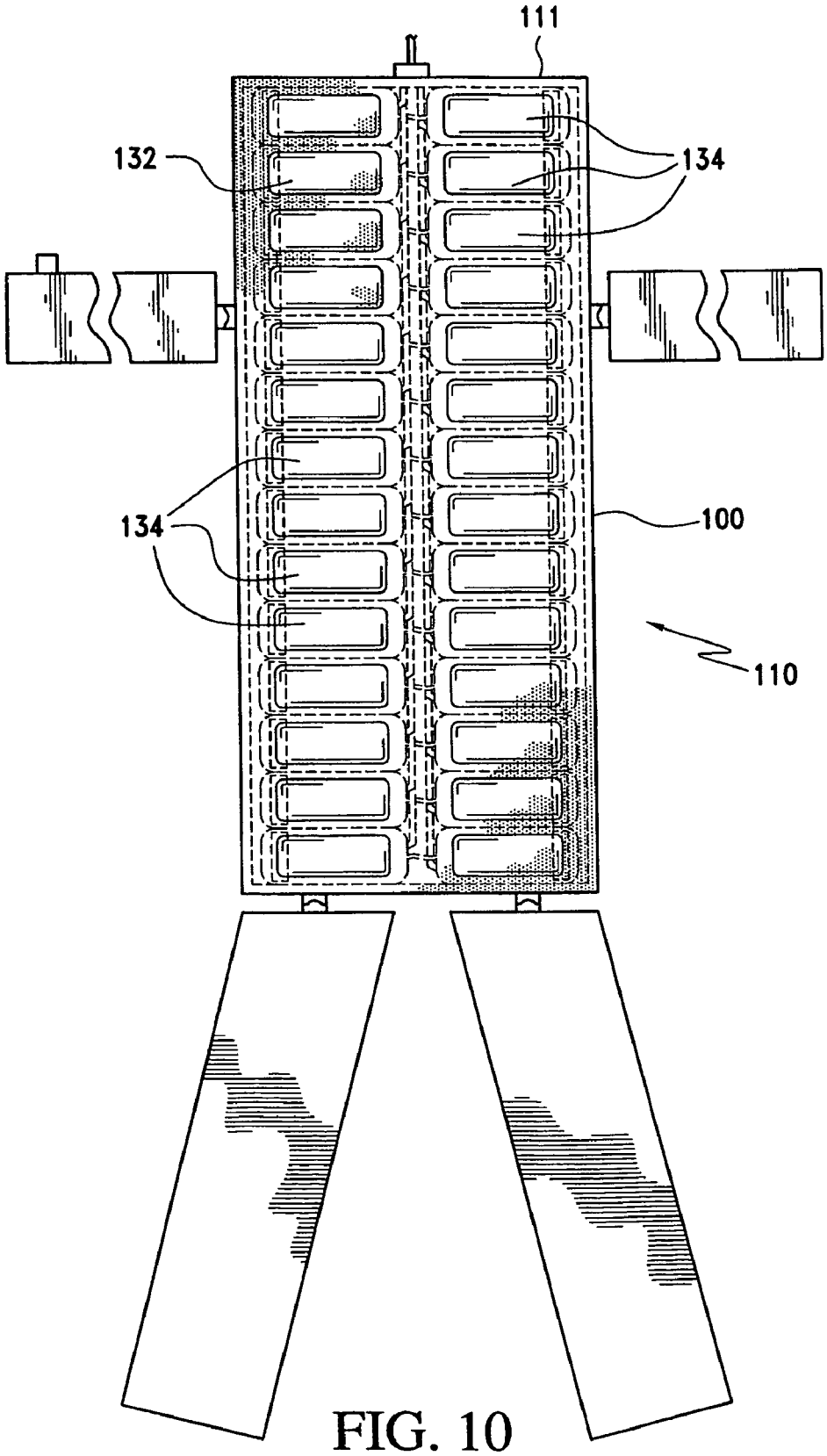
FIG. 10 is a top view of the portable platform in accordance with the present invention.

Referring to FIGS. 5 and 6, an alternate lift mechanism is disclosed. This mechanism is mechanically based and relies upon crossed linking arms 268, 270 positioned within each bladder 236 to control the elevation and lowering of patients in accordance with the present invention. The linking arms 268, 270 are controlled via a drive assembly 272 linked to a drive motor 274 to cause vertical movement of the bladders 236. However, such a mechanical lift mechanism might interfere with imaging, as it will likely be difficult to construct the linking arms and drive assembly of radiolucent materials.

Although preferred lift mechanisms have been disclosed in accordance with a preferred embodiment of the present invention, those skilled in the art will certainly appreciate that a variety of lift mechanisms are possible and may be employed without departing from the spirit of the present invention.

As to control of the various expansion members 28 making up the adjustment platform 26, it is preferred that the control system 44 include an interface 76 allowing a user to selectively control the elevation and/or lowering of each expansion member 28. With this mind, the control system 44 in accordance with a preferred embodiment, allows a user to select specific expansion members 28 and control the elevation or lowering thereof through the simple actuation of various control buttons 78 provided on the interface 76. As those skilled in the art will certainly appreciate, a variety of control systems may be used without departing from the spirit of the present invention.

Control of the present adjustment platform may be further enhanced by the provision of indicia 80 along the side of the surgical table 10 indicating the position of the various bladders 36. In this way, a surgeon need only look to the side of the table 10 and the patient to determine which bladder(s) 36 requires adjustment.

In addition, the usefulness of the present surgical table 10 is enhanced by the provision of a pulse oximeter plug 82 directly on the frame of the surgical table 10. As such, it is not necessary to drape wires across the operating room for linking the patient to a pulse oximeter.

In practice, the provision of the ability to distinctly elevate and lower various spinal portions in a highly controlled and reliable manner, allows one to open the interface between adjacent vertebrae to permit the installation of various spinal prosthetics in a highly convenient manner. In particular, it allows the surgeon to position himself or herself at the foot of the primary body support with the lower extremities in an abducted position. The abducted leg position is the most ideal position for spinal arthroplasty due to the midline orientation of the surgeon. While in this position, it allows the surgeon to control the spacing between adjacent vertebrae by either flexing or extending the spinal column through the expansion or contraction of the various bladders making up the present adjustment structure.

As discussed above, it is highly desirable the surgical table not interfere with imaging required for the performance of many surgical procedures. With this in mind, the present surgical table is constructed, to the extent possible, with radiolucent materials that will not interfere with required imaging.

As briefly mentioned above, and with reference to FIGS. 7 to 10, the concepts underlying the surgical table described above may be applied to a portable platform 110. The portable adjustable platform 110 includes the adjustable expansion members 128 discussed above maintained within a support frame 111 shaped and dimensioned to fit over the entire primary body support 116 or a portion of the primary body support of a conventional surgical table 100. More particularly, portable adjustment platform 110 includes a support frame 111 in which a series of individually controlled expansion members 128 are positioned in a manner extending along the length of the thereof The expansion members 128 are covered with a gel surfacing material 132 so as to provide a patient positioned thereon with a desirable contact surface upon which to lie. As with the prior embodiment, it is also contemplated "bean bag" like materials may be used as such materials are known to enhance user comfort. In accordance with a preferred embodiment, the gel surfacing material 132, although a continuous surface, is divided into a series of rectangular sections 134 substantially aligned with the various expansion members 128 making up the portable adjustment platform 110.

In accordance with a preferred embodiment of the present invention, the expansion members 128 are organized in two columns of approximately fourteen rows. Each expansion member 128 is approximately 10 inches in length and approximately 7 inches to approximately 9 inches in width, and approximately 3 inches to approximately 9 inches in height. As such, and in accordance with a preferred embodiment, the portable adjustment platform 110 is designed to extend the entire length and width of the primary body support. Although specific parameters are provided in accordance with a preferred embodiment, it is contemplated the arrangement of expansion members may be varied to suit specific applications without departing from the spirit of the present invention, for example, it is contemplated that 3 columns of expansion members may be useful.

In accordance with an alternate embodiment of the present invention, and as discussed above with regard to the surgical table embodiment, it is contemplated that the length of each expansion member 128 may be varied.

The expansion of each expansion member 128 is preferably controlled using a pressurized water or air based actuation system as discussed above with regard to the surgical table embodiment. With this in mind, and in accordance with a preferred embodiment of the present invention, each expansion member 128 includes a bladder 136 having an outer shell 138. The shell 138 is preferably composed of an elastomer, although those skilled in the art will appreciate that other materials may be used without departing from the spirit of the present invention. The shell 138 includes an inner cavity 140 that is connected to a pressurized source of water 142, which is pumped into or released from the bladder 136 via fluid tubes 146 under the control of a control unit 144 discussed below in greater detail. The shell 138 further includes an upper surface 148, a lower surface 150, first and second lateral side surfaces 152, 154 and first and second lengthwise side surfaces 156, 158.

As discussed above, the gel surfacing material 132 is positioned upon the expansion members 128. With this in mind, the upper surface 148 of each bladder 136 is provided with a hook and loop fastening material 160 for secure engagement with the underside 162 of the gel surfacing material 132.

In addition to simply pumping fluid or air into and out of the bladder 136, controlled lifting of a patient is achieved by the provision of rollers 164 which function to mechanically limit the lateral volume of the bladder 136 so as to force vertical expansion thereof. More particularly, each bladder 136 is provided with a first lateral side surface 152 and second lateral side surface 154. Lateral expansion of the second lateral side surface 154 of each bladder 136 is controlled by the fact that the second lateral side surface 154 of adjacent bladders 136 are in a facing relationship along the length of the portable adjustment platform 126 and abut with various structures extending along the center of the adjustment platform 110. Similarly, the first and second lengthwise side surfaces 156, 158 of the bladders 136 abut to control expansion along the plane of the portable platform 110. Expansion of the bladders 136 in the direction of the second lateral side surface 154, as well as the first and second lengthwise side surfaces 156, 158, is further facilitated by linking the abutting surfaces of the adjacent bladders 136 with a binding material 166, for example, spandex.

As to lateral expansion along the first lateral side surface 152 of the bladder 136, it is controlled by a roller 164 which adjustably contracts or expands the distance from the first lateral side surface 152 of the bladder 136 to the second lateral side surface 154 of the bladder 136 to thereby limit the lateral volume available within the bladder 136, which ultimately forces any applied pressure to expand the bladder 136 in a vertical direction.

The roller 164 functions by engaging the first lateral side surface 152 of the bladder 136, clamping down thereon, and moving relative to the first lateral side surface 152 of the bladder 136 to limit the distance from the second lateral side of the expansion member to the roller 164, or first lateral side surface 152, of the bladder 136.

Although preferred lift mechanisms have been disclosed in accordance with a preferred embodiment of the present invention, those skilled in the art will certainly appreciate that a variety of lift mechanisms are possible and may be employed without departing from the spirit of the present invention.

As to control of the various expansion members 128 making up the portable platform 110, the control system 144 is preferably similar to that disclosed above with reference to the surgical table embodiment.

As discussed above, it is highly desirable the present portable platform not interfere with imaging required for the performance of many surgical procedures. With this in mind, the present portable platform is constructed, to the extent possible, with radiolucent materials that will not interfere with required imaging.

Although the present invention has been described above with reference to the performance of non-fusion type spinal procedures, the concepts underlying the present invention may be applied to a variety of surgical procedures without departing from the spirit of the present invention. For example, it is contemplated the present surgical table may be employed in prostrate surgery, endo-surgeries, gastric bypass surgery, spinal endoscopy, etc.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A surgical table, comprising:

a horizontal patient support with a base extending therefrom and supporting the patient support at a desired height;

an adjustment platform positioned upon the patient support, the adjustment platform including a plurality of expansion members adapted to selectively adjust the relative position of the patient; wherein the expansion members each include a shell under the control of a pressurized fluid or air and the expansion members each include a volume adjustment member which is a roller acting upon the expansion member to control the lateral volume thereof.

2. The surgical table according to claim 1, wherein the adjustment platform includes a gel surfacing material positioned over the expansion members.

3. The surgical table according to claim 1, wherein the expansion members are organized in two parallel columns.

4. The surgical table according to claim 1, wherein the expansion members each include a shell under the control of a pressurized fluid or air.

5. The surgical table according to claim 4, wherein the expansion members each include a volume adjustment member.

6. The surgical table according to claim 1, wherein the patient support includes a primary body support shaped and dimensioned for supporting a patient's torso, lateral extending arm supports, and leg supports extending from a first end of the primary body support, wherein the adjustable platform is positioned upon the primary body support.

7. The surgical table according to claim 6, wherein the adjustment platform is shaped and dimensioned to extend over the entire length and width of the primary body support.

8. The surgical table according to claim 6, wherein the primary body support is composed of a radiolucent material.

9. The surgical table according to claim 8, wherein the radiolucent material is selected from the group consisting of a carbon fiber sandwich, epoxy, decorative foam laminate, polypropylene, phenolic resin, carbon fiber/foam combination, polycarbonate, acrylic polymer and a combination of these materials.

10. The adjustment platform according to claim 1, wherein each expansion member includes a bladder, and each bladder includes lateral side surfaces and lengthwise side surfaces, wherein lateral expansion of the bladders is controlled by abutting lateral side surfaces of adjacent bladders and lengthwise expansion of the bladders is controlled by abutting lengthwise side surface of adjacent bladders.

11. An adjustment platform, comprising:

a frame;

a plurality of expansion members positioned within the frame, the expansion members being adapted to selectively adjust the relative position of the patient lying upon the platform, wherein a expansion members each include a shell under the control of a pressurized fluid or air and the expansion members each include a volume adjustment member which is a roller acting upon the expansion member to control the lateral volume thereof.

12. The adjustment platform according to claim 11, further including a gel surfacing material positioned over the expansion members.

13. The adjustment platform according to claim 11, wherein the expansion members are organized in two parallel columns.

14. The adjustment platform according to claim 11, wherein the expansion members each include a volume adjustment member.

15. The adjustment platform according to claim 11, wherein the adjustment platform is shaped and dimensioned to extend over the entire length and width of a primary body support of a surgical table.

16. The adjustment platform according to claim 11, wherein the adjustment platform is composed of a radiolucent material.

17. The adjustment platform according to claim 16, wherein the radiolucent material is selected from the group consisting of a carbon fiber sandwich, epoxy, decorative foam laminate, polypropylene, phenolic resin, carbon fiber/foam combination, polycarbonate, acrylic polymer and a combination of these materials.

18. The adjustment platform according to claim 11, wherein each expansion member includes a bladder, and each bladder includes lateral side surfaces and lengthwise side surfaces, wherein lateral expansion of the bladders is controlled by abutting lateral side surfaces of adjacent bladders and lengthwise expansion of the bladders is controlled by abutting lengthwise side surface of adjacent bladders.

* * * * *